US006469459B2

(12) United States Patent
Ono

(10) Patent No.: US 6,469,459 B2
(45) Date of Patent: Oct. 22, 2002

(54) CATHODE RAY TUBE APPARATUS

(75) Inventor: Osamu Ono, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/772,902

(22) Filed: Jan. 31, 2001

(65) Prior Publication Data

US 2002/0047670 A1 Apr. 25, 2002

(30) Foreign Application Priority Data

Jan. 31, 2000 (JP) ..... 2000-022651

(51) Int. Cl.[7] ..... H01J 29/46
(52) U.S. Cl. ..... 315/382; 313/414
(58) Field of Search ..... 315/382, 382.1, 315/368.15, 368.24, 14, 15, 16, 17; 313/412, 413, 414

(56) References Cited

U.S. PATENT DOCUMENTS 6,002,201 A * 12/1999 Noguchi ..... 313/414

FOREIGN PATENT DOCUMENTS

JP 64-38947 2/1989
JP 2000-48738 2/2000

* cited by examiner

*Primary Examiner*—David Vu
(74) *Attorney, Agent, or Firm*—Oblon, Spivak, McClelland, Maier & Neustadt, P.C.

(57) ABSTRACT

The cathode ray tube apparatus comprises a main lens constructed by focus, intermediate, and final acceleration electrodes. The main lens includes a focusing area positioned in a side of the focus electrode, and a diverging area positioned in a side of the final acceleration electrode. A focusing force curve expressing the focusing force along the tube-axis direction in the focusing area has two convex parts respectively being at first and second levels, and a concave part provided between the convex parts and being at a third level sufficiently lower than the first and second levels. The third level is set to a lowermost level at which a focusing or diverging force is not substantially effected on the electron beam. An intermediate electrode having a non-circular shaped hole is positioned near an area of the lowermost level.

11 Claims, 4 Drawing Sheets

CATHODE RAY TUBE APPARATUS

CROSS-REFERENCE TO RELATED APPLICATIONS

This application is based upon and claims the benefit of priority from the prior Japanese Patent Application No. 2000-022651, filed Jan. 31, 2000, the entire contents of which are incorporated herein by reference.

BACKGROUND OF THE INVENTION

The present invention relates to a cathode ray tube apparatus comprising an electron gun assembly which emits one or more electron beams, and particularly to a cathode ray tube apparatus in which focus characteristics of the electron beam or beams are improved so that high resolution is obtained for the entire screen.

In general, in a color cathode ray tube apparatus, the three-electron beams emitted from an electron gun assembly is deflected by horizontal and vertical deflection magnetic fields. The deflected beams are oriented to a fluorescent screen made of a three-color fluorescent layers which are scanned horizontally and vertically by the electron beams so that a color image is displayed on the fluorescent screen.

Particularly, in this cathode ray tube apparatus, there is a trend as follows. That is, the electron gun assembly is constructed as an in-line type electron gun assembly which emits three electron beams arranged in line and including one center beam and a pair of side beams which penetrate in one same horizontal plane. On the other hand, its deflection yoke generates a horizontal deflection magnetic field of a pincushion type and a vertical deflection magnetic field of a barrel type, thereby to converge the three electron beams emitted from the electron gun assembly and arranged in line, onto a phosphor screen.

In this kind of cathode ray tube apparatus, the deflection magnetic field described above is not uniform, and therefore, the electron beam spot receives a diverging effect in the horizontal direction, causing an under-focused state even if the electron beam spot formed on the center part of the phosphor screen is a true circle. In the vertical direction, the electron-beam spot receives a focusing effect, causing an over-focused state.

Further, the distance from the electron gun assembly to the phosphor screen increases with the deflection amount of the electron beam. Accordingly, even if the electron beams spot is formed to be a true circle at the center part of the phosphor screen, the beam spot becomes over-focused at the peripheral portion of the phosphor screen.

As a result of this, the electron spot at the periphery part of the phosphor screen becomes remarkably over-focused in the vertical direction due to the two effects described above, and the above two effects compensate for each other in the horizontal direction to cause a substantially focused state. That is, in the peripheral part of the phosphor screen, astigmatic aberration caused due to a difference in the focus state between the vertical and horizontal directions. As shown in FIG. 1, the electron beam spot 2 is deformed into an asymmetric shape composed of a core part 3 as a high-luminance part and a halo part 4 as a low-luminance part, so that the resolution is remarkably degraded at the peripheral part of the phosphor screen. In addition, deflection aberration received by the electron beam increases as the scale of the cathode ray tube apparatus increases and the deflection angle increases. In this case, the resolution at the peripheral part of the phosphor screen is deteriorated much more.

To modify the electron beam spot, it is also important that the electrode forming the main lens of the electron gun assembly is formed with a large hole diameter so as to reduce the spherical aberration. Therefore, the mutual distance between the three electron beams must be set large. However, if the electron gun assembly is designed to have a large mutual distance between the three electron beams, there is a problem that the convergence characteristic of the three electron beams is deteriorated. Also, the hole diameter of the electrode forming the main lens part is limited by the inner diameter of the neck where electron gun assembly is provided. That is in order to attain an excellent resolution of the color cathode ray tube apparatus, it is necessary to enlarge the effective diameter of the main lens without increasing the mutual distance between the three electron beams, and to improve deformation of the electron beam spot at the peripheral part of the screen.

As a method of achieving improvements for an enlarged diameter and a deflection deformation of the main lens, Japanese Patent Application KOKAI Publication No. 64-38947 proposes an electron gun assembly having a structure as follows. In this electron gun assembly, the main lens is comprised of a focus electrode G5, two intermediate electrodes Gm1 and Gm2, and a final acceleration electrode G6. In the electron gun assembly shown in these FIGS. 2A and 2B, a high voltage applied to the final acceleration electrode G6 is divided by a resistor T provided along the electrode of the electron gun assembly, and predetermined divided voltages are applied to the intermediate electrodes Gm1 and Gm 2. In addition, a dynamic voltage having a parabola shape which changes in accordance with deflection of the electron beam is applied to the focus electrode G5, superposed into a constant direct current voltage. All the beam-passing holes of the focus electrode G5, intermediate electrodes Gm1 and Gm 2, and the final acceleration electrode G6 are each formed to be a true circular shape. In addition, no side wall part, i.e., no bar ring is formed on the side surface of each electron-beam-passing hole, in the focus electrode G5 and the final acceleration electrode G6. Therefore, an electric field common to three electron beams is formed in the horizontal direction inside the focus electrode G5 and the final acceleration electrode G6. As a result of this, a first quadrapole lens having a strong focusing effect in the relatively vertical direction is formed near the focus electrode G5, and a second quadrapole lens having a strong diverging effect in the relatively vertical direction is formed near the final acceleration electrode G6.

Accordingly, in the electron gun assembly having a structure as described above, an enhanced electric field lens in which the main lens is enhanced by the intermediate electrodes Gm1 and Gm2 can be formed. Further, if the electron beam is deflected at the peripheral parts of the screen, the focus electrode G5 is supplied with a higher voltage (dynamic voltage) in accordance with the deflection of the electron beam, so that the voltage difference is decreased between the focus electrode G5 and the intermediate electrode Gm1. Therefore, the effect of the first quadrapole lens is weakened. Accordingly, the electron beam is diverged in the vertical direction while the focused state of the electron beam is not substantially changed in the horizontal direction. As a result, it is possible to compensate for the over-focusing in the vertical direction, which is caused by the non-uniform magnetic field generated from the deflection yoke. In the horizontal direction, deterioration of the magnification is smaller compared with a dynamic electron gun assembly in which a quadrapole lens is provided in the side closer to the cathode side than the main lens. Therefore, the electron-beam spot can have a smaller diameter.

By the electron gun assembly having a structure as described above, it is possible to solve two problems, i.e., the enlarged effective diameter described above and improvement concerning the deterioration of the resolution due to deflection aberration described above.

However, in case of the electron gun assembly having the structure described above, no side wall part (bar ring) is formed on the side surface of each of the electron-beam-passing holes, and therefore, the effective diameter is smaller in the vertical direction than in the horizontal direction. Consequently, the lens magnification and spherical aberration are enlarged so much that the diameter of the electron beam spot in the vertical direction becomes larger than that of the electron beam spot in the horizontal direction. As a result, the resolution is deteriorated at the center part of the screen. In particular, if the size and deflection angle of the cathode ray tube apparatus are large, it is necessary to strengthen the effect of the first quadrapole lens. In this case, the true circular shape of each hole formed in the focus electrode G5 and the final acceleration electrode G6 may be changed into a laterally elongated shape. However, the effective diameter is much more reduced in the vertical direction, so that the spherical aberration in the vertical direction is more increased, and the electron beam spot is much more elongated in the longitudinal direction at the center part of the screen. Consequently, the resolution is remarkably deteriorated in the center part of the screen.

As described above, in order to obtain an excellent resolution of the cathode ray tube apparatus, it is necessary to enlarge the effective diameter of the main lens without increasing a large mutual distance between three electron beams, and to improve deformation of the electron beam spots at the peripheral part of the screen.

As an electron gun assembly which achieves an enlargement of the effective diameter of the main lens and the improvement of the deflection deformation, there has been an electron gun assembly as follows. In this gun, the main lens is constructed by a focus electrode, an intermediate electrode applied with a desired voltage divided by a resistor incorporated in the tube, and a final acceleration electrode. Near the focus electrode, asymmetric focusing electric field which provides a strong focusing effect relatively in the vertical direction is created near the focus electrode, and an asymmetric diverging electric field which provides a strong diverging effect relatively in the vertical direction is created near the final acceleration electrode. The asymmetric focusing electric field and the asymmetric diverging electric field are separated substantially by the intermediate electrode, so that a dynamic voltage which changes in synchronization with deflection of the electron beam is supplied to the focus electrode.

However, by merely adopting this structure, the lens magnification and the spherical aberration are increased much more in the vertical direction than in the horizontal direction, and the electron beam spot diameter becomes larger in the vertical direction than in the horizontal direction, so that the resolution is deteriorated at the center part of the screen. In particular, if the size and deflection angle of the cathode ray tube apparatus are large, the lens magnification and the spherical aberration in the vertical direction are increased much more, resulting in a problem that the resolution is remarkably deteriorated.

BRIEF SUMMARY OF THE INVENTION

An object of the present invention is to provide a cathode ray tube apparatus comprising an electron gun assembly in which the diameter of the electron beam spot is small and uniform throughout the entire area of the phosphor screen, so that the resolution of the cathode ray tube apparatus can be improved.

According to the present invention, there is provided a cathode ray tube apparatus comprising: an envelope having a screen; and an electron gun assembly constructed by a cathode for emitting an electron beam, and a main lens including a focus electrode, an intermediate electrode, and a final acceleration electrode, to focus the electron beam emitted toward the screen, the intermediate electrode being provided between the focus electrode and the final acceleration electrode, and wherein the main lens includes a focusing area positioned in a side of the focus electrode and having a focusing force, and a diverging area positioned in a side of the final acceleration electrode, having a diverging force, and being continuous to the focusing area, that the intermediate electrode has a hole having a non-circular shape for allowing the electron beam to pass and is provided in the focusing area in the side of the focus electrode, that a focusing force curve expressing a focusing force along a tube-axis direction of the cathode ray tube apparatus in the focusing area has at least two convex parts respectively being at first and second levels, and a concave part provided between the convex parts and being at a third level sufficiently lower than focusing forces of the first and second levels, that the third level is set to a lowermost level at which a focusing or diverging force is not substantially effected on the electron beam or a focusing or diverging force is sufficiently small even if it is effected, that the intermediate electrode is positioned near an area of the lowermost level, and that at least one electrode constructing the main lens is applied with a dynamic voltage which changes in synchronization with deflection of the electron beam.

Also, according to the present invention, there is provided a cathode ray tube apparatus having the structure as described above and wherein the focusing force or diverging force at the lowermost level has an absolute value which is substantially equal to or less than half of a uppermost focusing force which can be effected by the main lens.

Further, according to the present invention, there is provided a cathode ray tube apparatus having the structure as described above and wherein an asymmetric intermediate electrode is provided at or near a boundary part between the large focusing area positioned in the side of the focus electrode and the large diverging area positioned in the side of the final acceleration electrode.

Further, according to the present invention, there is provided a cathode ray tube apparatus having the structure as described above and wherein a quadrapole lens is provided in a side of the cathode of the main lens, and a dynamic voltage which changes in synchronization with deflection of the electron beam is applied to an electrode constructing the quadrapole electrode.

According to the present invention, there is provided a cathode ray tube apparatus comprising: an envelope having a screen; and an electron gun assembly constructed by a cathode for emitting an electron beam, and a main lens including a focus electrode, an intermediate electrode, and a final acceleration electrode, to focus the electron beam emitted toward the screen, the intermediate electrode being provided between the focus electrode and the final acceleration electrode, and wherein the main lens includes a focusing area positioned in a side of the focus electrode and having a focusing force, and a diverging area positioned in a side of the final acceleration electrode, having a diverging force, and being continuous to the focusing area, that an intermediate electrode having a non-circular shaped hole for allowing the electron beam to pass is provided in the diverging area in the side of the final acceleration electrode, that a focusing force curve expressing a focusing force along a tube-axis direction of the cathode ray tube apparatus in the focusing area has a convex part, that the curve at the convex part includes a part being at a uppermost level,.that the uppermost level is set such that a focusing or diverging force is not substantially effected on the electron beam or a focusing or diverging force is sufficiently small even if it is effected, that the intermediate electrode is positioned near the part of the uppermost level, and that the electrode constructing the main lens is applied with a dynamic voltage which changes in synchronization with deflection of the electron beam.

Further, according to the present invention, there is provided a cathode ray tube apparatus having the structure as described above and wherein the focusing force or diverging force at the uppermost level has an absolute value which is substantially equal to or less than half of a uppermost diverging force which can be effected by the main lens.

Further, according to the present invention, there is provided a cathode ray tube apparatus comprising: an envelope having a screen; and an electron gun assembly constructed by a cathode for emitting an electron beam, and a main lens including a focus electrode, an intermediate electrode, and a final acceleration electrode, to focus the electron beam emitted toward the screen, the intermediate electrode being provided between the focus electrode and the final acceleration electrode, and wherein the main lens includes a focusing area positioned in a side of the focus electrode and having a focusing force, and a diverging area positioned in a side of the final acceleration electrode, having a diverging force, and being continuous to the focusing area, that an intermediate electrode having a non-circular shaped hole for allowing the electron beam to pass is provided in the focusing area in the side of the focus electrode and in the diverging area in the side of the final acceleration electrode, that a focusing force curve expressing a focusing force along a tube-axis direction of the cathode ray tube apparatus in the focusing area has at least two convex parts respectively being at first and second levels and a concave part provided between the convex parts and being at a third level which is sufficiently smaller than focusing forces of the first and second levels, that the third level is set to a lowermost level at which a focusing or diverging force is not substantially effected on the electron beam or a focusing or diverging force is sufficiently small even if it is effected, that the intermediate electrode having the non-circular shaped hole is provided near the part of the lowermost level, that the intermediate electrode is provided in the diverging area in the side of the final acceleration electrode, that the focusing force curve expressing the focusing force along the tube axis direction of the cathode ray tube apparatus in the diverging area is formed to be a convex part, that the curve at the convex part has a part being at a uppermost level, that the uppermost level is set such that a focusing or diverging force is not substantially effected on the electron beam or a focusing or diverging force is sufficiently small even if it is effected, the intermediate electrode having the non-circular shaped hole is provided near the part of the uppermost level, and that the electrode constructing the main lens is applied with a dynamic voltage which changes in synchronization with deflection of the electron beam.

Also, according to the present invention, there is provided a cathode ray tube apparatus having the structure as described above and wherein an asymmetric intermediate electrode is provided at or near a boundary of the large focusing area positioned in the side of the focus electrode and the large diverging area positioned in the final acceleration electrode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode ray tube according to an embodiment of the present invention will now be explained with reference to the drawings.

Figure 1:
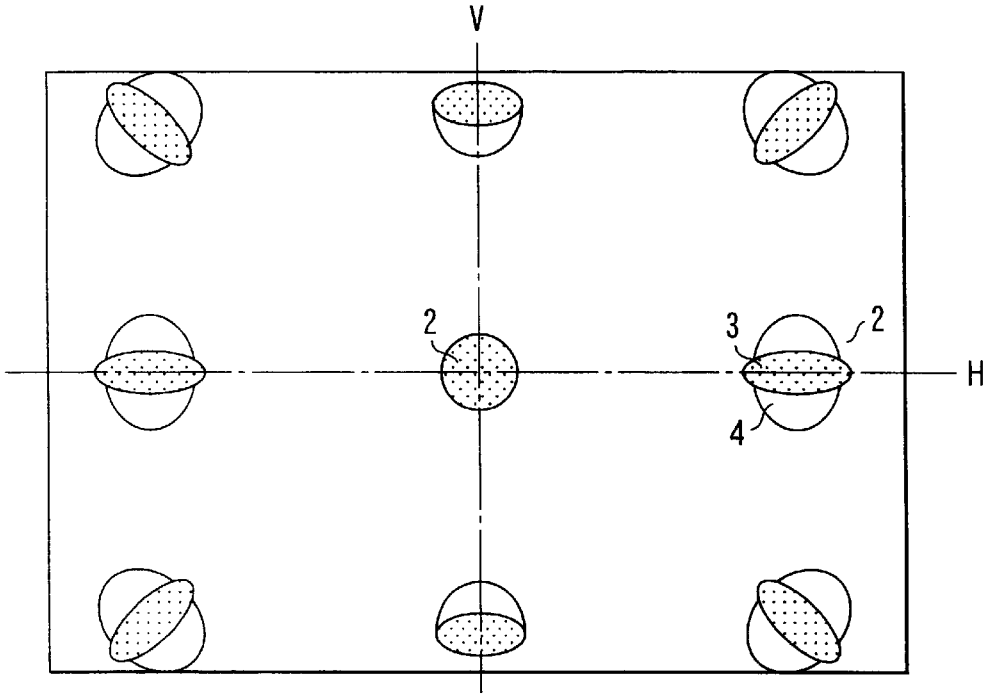
FIG. 1 BACKGROUND ART
FIG. 1 is a view for explaining deflection aberration of a conventional color cathode ray tube apparatus of an inline type.
Figure 3:
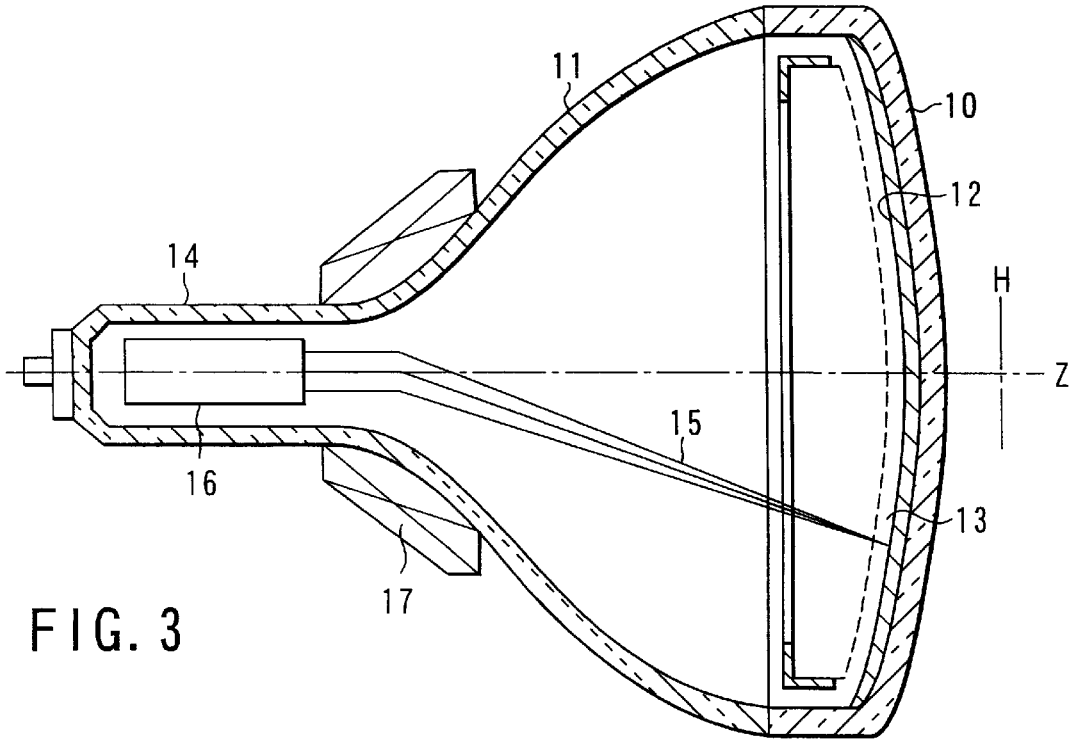
FIG. 3 is a cross-sectional view schematically showing a cathode ray tube apparatus according to an embodiment of the present invention.
Figure 2A:
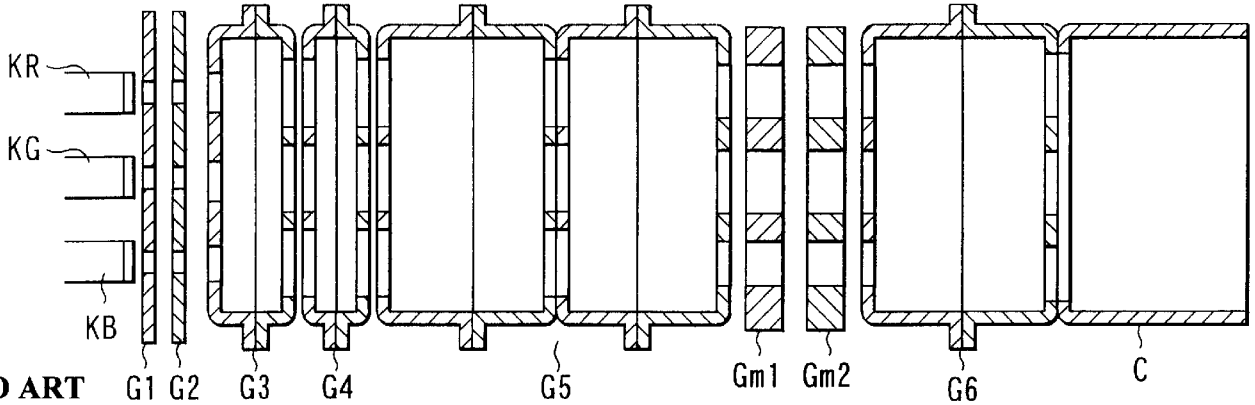
FIG. 2A BACKGROUND ART
FIGS. 2A and 2B are cross-sectional views in horizontal and vertical planes, showing schematically the structure of a conventional electron gun assembly.
Figure 2B:
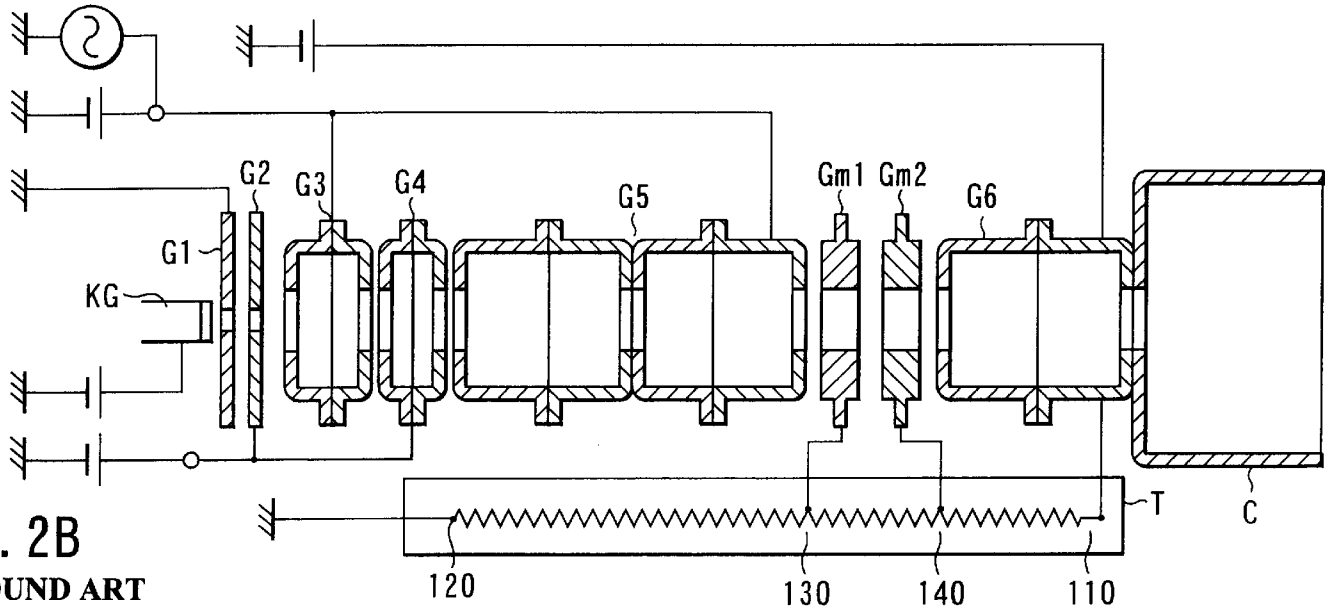
FIG. 2B BACKGROUND ART

FIG. 3 shows a color cathode ray tube according to an embodiment of the present invention. As shown in FIG. 3, the color cathode ray tube has an envelope comprised of a panel 10 and a funnel 11 joined integrally to the panel 10. A phosphor screen 12 made of a strip-like three fluorescent layers for emitting light rays in blue, green, and red are formed on the inner surface of the panel 10. A shadow mask 13 is attached so as to oppose the phosphor screen 12, and a large number of apertures are formed in the inner surface of the shadow mask 13. Meanwhile, an electron gun assembly 16, which emits three electron beams 15B, 15G, and 15R arranged in line and pass through one same horizontal surface in the neck 14 of the funnel 11, is provided in the neck 14. A deflection yoke 17 is attached to the outside of the funnel 11. Further, the three electron beams 15B, 15G, and 15R emitted from the electron gun assembly 16 are deflected by horizontal and vertical deflection magnetic fields generated by the deflection yoke 17 and are thereby oriented to the phosphor screen 12 through the shadow mask 13. The phosphor screen 12 is scanned horizontally and vertically by the three electron beams 15B, 15G, and 15R, thereby displaying a color image on the phosphor screen 12.

Figure 4A:
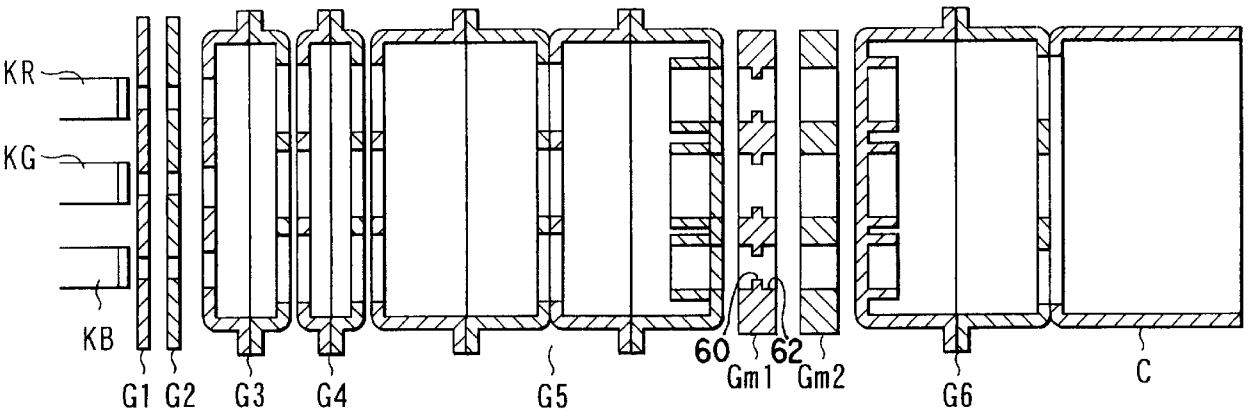
FIGS. 4A and 4B are cross-sectional views in horizontal and vertical planes, showing schematically the structure of an electron gun assembly incorporated in the cathode ray tube apparatus shown in FIG. 3.
Figure 4B:
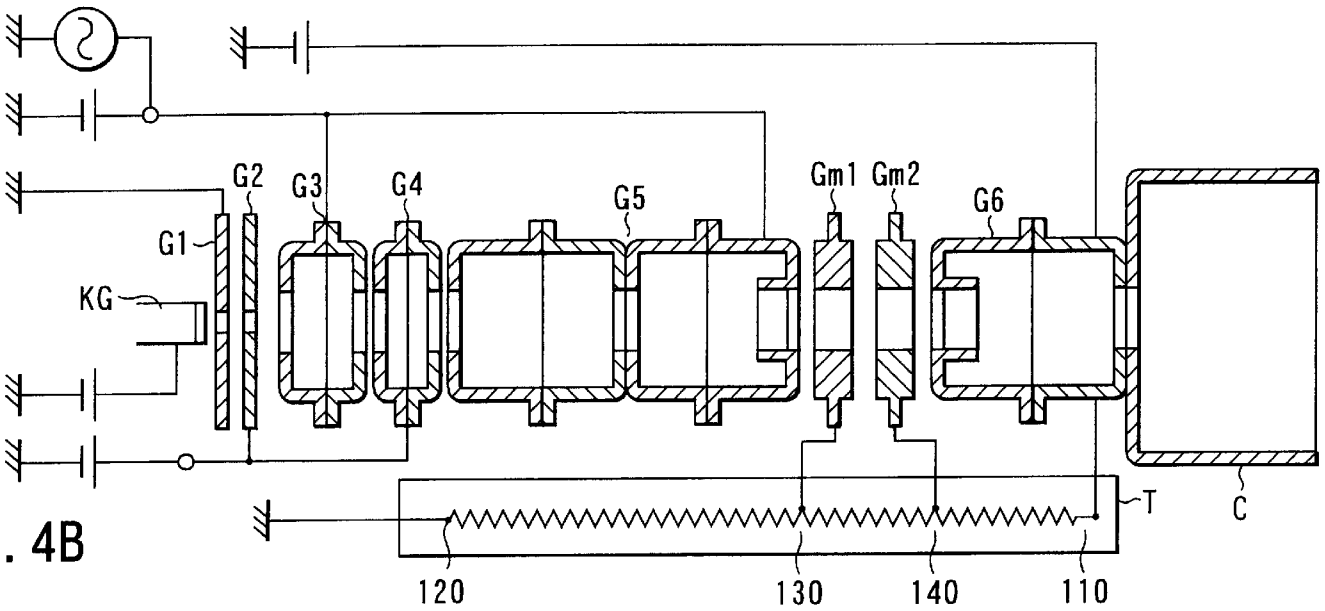

As shown in FIGS. 4A and 4B, the electron gun assembly 16 has a structure in which three cathodes KR, KG, and KB arranged in line in the horizontal direction, and heaters H (not shown) for individually heating the three cathodes KR, KG, and KB are provided. Also, a first grid G1, a second grid G2, a third grid G3, a fourth grid G4, a fifth grid G5, first and second intermediate electrodes Gm1 and Gm2, a sixth grid G6, and a convergence cup C are arranged in this order between the cathodes KR, KG, and KB and the phosphor screen 12. In addition, the first to sixth grids G1 to G6 are supported and fixed by an insulating support rod (not shown), and the convergence cup C is attached to the sixth grid G6.

Also, a resistor T as shown in FIG. 4B is provided near the electron gun 16. An end 110 of the resistor T is connected to the sixth grid G6, the other end 120 is grounded, and intermediate nodes 130 and 140 are respectively connected to the first and second intermediate electrodes Gm1 and Gm2.

Figure 5:
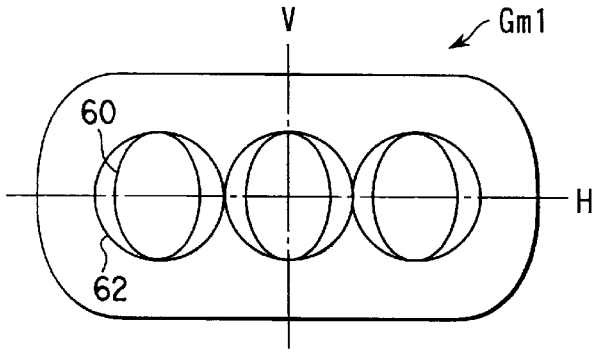
FIG. 5 is a front view showing an asymmetric electrode provided in the main lens of the electron gun assembly shown in FIGS. 4A and 4B.

Three electron beam passing holes, which have a predetermined size and are arranged in line in the horizontal direction, are formed in each of the grids. The first grid G1 and the second grid G2 are each constructed by a thin plate-like electrode, and three circular electron beam passing holes with a small diameter are formed in each of the plate-like electrodes. The third grid G3, fourth grid G4, fifth grid G5, and sixth grid G6 are structured such that a plurality of cup-like electrodes are arranged so as to oppose each other. Three circular electron beam passing holes with a slightly larger diameter than that of the holes formed in the second grid G2 are formed in the side of the third grid G3 that faces the second grid G2. Three electron beam passing holes with a large diameter are formed in the side of the third grid G3 that faces the fourth grid G4, as well as in both sides of each of the fourth grid G4, the fifth grid G5, and the sixth grid G6. Further, a side wall part which is a bar ring is formed on the peripheral edge of each of the electron beam passing holes in the side of the fifth grid G5 that faces the first intermediate electrode Gm1 and in the side of the sixth grid G6 that faces the second intermediate electrode Gm2. In each of the first and second intermediate electrodes Gm1 and Gm2 which are constructed by a thick plate-like electrode, three electron beam passing holes having a large diameter are formed, and the electron beam passing holes of the second intermediate electrode Gm2 are formed into true circles. The electron beam passing holes 62 of the first intermediate electrode Gm1 are each formed into a true circle in each of its two ends as shown in FIGS. 4A and 5. However, the inside of each of these electron beam passing holes is formed into a longitudinally long hole 60 whose horizontal diameter smaller than its vertical diameter. That is, the first intermediate electrode Gm1 has a two-hole structure in which the opening ends of each hole is so formed as the circular hole 62 and projections are so formed in the hole 62 as to defined a elliptical hole 62 having a longitudinal axis elongated in the vertical direction.

In the electron gun assembly described above, the cathodes KR, KG, and KB are applied with a direct current voltage of about 100V to 200V and a modulation signal corresponding to an image. The first grid G1 is grounded, and the second grid G2 is applied with about 500 to 1000 V, during operation. A triode is then formed by these cathodes KR, KG, and KB, and the first and second grids G1 and G2, and electron beams are emitted from the cathodes KR, KG, and KB, thereby forming a cross-over.

The third grid G3 and the fifth Grid G5 are connected to each other inside the tube, and a dynamic voltage having a parabola-like shape, which changes in synchronization with deflection of the electron beams, is superposed on a constant direct current voltage of about 6 kV to 10 kV, thereby to obtain a focus voltage. This focus voltage is applied to the third grid G3 and the fifth grid G5. Also, the fourth grid G4 is connected to the second grid G2 inside the tube, so that the third grid G3, the fourth grid G4, and the fifth grid G5 construct a supplementary lens, thereby to focus preliminarily the electron beams.

The sixth grid G6 is applied with a final acceleration voltage of about 22 kV to 35 kV, and the first intermediate electrode Gm1 is supplied with a desired voltage which is higher than the focus voltage and lower than the voltage of the second intermediate electrode Gm2, by the resistor T. The second intermediate electrode Gm2 is supplied with a voltage which is higher than the first intermediate electrode Gm1 and is lower than the final acceleration voltage, also by the resistor T. Further, a main lens is formed by the fifth grid G5, the first and second intermediate electrodes Gm1 and Gm2, and the sixth grid G6, and the electron beams are finally focused on the screen. Thus, the area of the main lens is enhanced by the first and second intermediate electrodes Gm1 and Gm2, and the electric potential is smoothly increased from the fifth grid G5 to the sixth grid G6. As a result of this, an enhanced electric field lens is formed with a large effective diameter. It is therefore possible to reduce the size of each beam spot.

Figure 6:
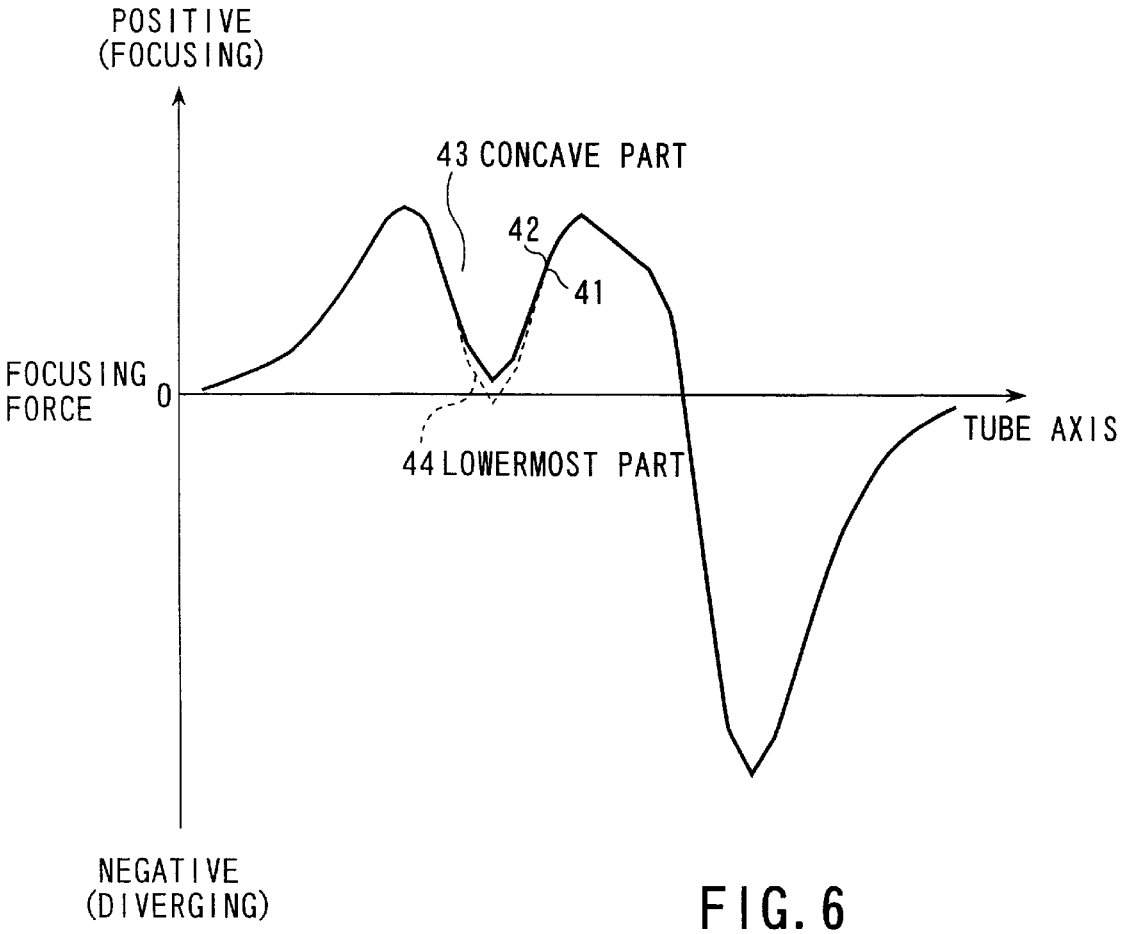
FIG. 6 is a graph showing a characteristic curve concerning the focusing force in the main lens of the electron gun assembly shown in FIGS. 4A and 4B.

Further, in the above electron gun, the focusing force of the main lens near the tube axis takes a distribution as shown in FIG. 6 because the layout and the voltages of the first and second intermediate electrodes Gm1 and Gm2 are set in an appropriate structure if the electron beams are oriented to the screen center part, i.e., if no dynamic voltage is applied to the third and fifth grids as focus electrodes. FIG. 6 shows the focusing force of the main lens as a result of simulating an electric field distribution by a calculator and analyzing the electric field distribution. Here, the curve (broken line) indicated by the code 41 expresses the focusing force in the horizontal direction, and the curve (continuous line) indicated by the code 42 expresses the focusing force in the vertical direction.

Note that the focusing force expresses the electric field strength in the direction in which the electron beams are oriented toward the tube axis, wherein the direction in which the electron beams are oriented toward the tube axis is positive, i.e., a focusing effect, and the direction in which the electron beams are oriented in the direction opposite to the direction toward the tube axis is negative, i.e., a diverging effect.

As is apparent from FIG. 6, the main lens of the electron gun assembly has a large focusing area positioned in the focus electrode side and a large diverging area positioned in the final acceleration electrode side. In the large focusing area described above, a concave part 43 is formed between convex curve segments having first and second levels, with respect to the graph of the focusing effect. A lowermost part 44 is included in the concave part 43, and an area which is not substantially focused or diverged is formed at the lowermost part 44. Also, the horizontal focusing force 41 and the vertical focusing force 42 are at a substantially equal level, although an asymmetric electrode having non-circular shaped holes (e.g., longitudinally or laterally elongated holes) is provided inside the first intermediate electrode Gm1. This is because longitudinally elongated holes formed in the first intermediate electrode Gm1 is provided near the lowermost part 44 as an area which does not substantially cause focusing or diverging. Accordingly, there is constructed an electron lens having a lens magnification and an aberration which are substantially equal both in the horizontal and vertical directions. Further, the main lens is an enhanced electric field lens having a large effective diameter, as described above, and therefore, an electron beam spot having a substantially true circle and a small diameter can be formed at the center part of the screen.

Meanwhile, if the electron beams are deflected toward the peripheral part of the screen, i.e., if a dynamic voltage is applied to the focus electrode, the potential distribution in case where the electron beams are not deflected causes a change, a quadrapole lens is formed by the longitudinally elongated holes formed in the first intermediate electrode Gm1 so that a difference is caused between the horizontal focusing force and the vertical focusing force. Accordingly, the electron beams receive the focusing effect in the horizontal direction as well as the diverging effect in the vertical direction, from the quadrapole lens. Furthermore, a lens power of the main lens is decreased so that the main lens bring to have functions of applying no focusing and diverging effects on the electron beams in the horizontal direction and a divergent effect on the electron beams in the vertical direction. Therefore, in the vertical direction, it is possible to compensate for the over-focused state in the vertical direction, which is received from the non-uniform magnetic field of the deflection yoke. In the horizontal direction, a substantially focused state is created, and further, a quadrapole lens is formed in the side much closer to the phosphor screen 12, compared with a conventional electron gun assembly. Therefore, the electron beam spots can be created with a smaller diameter compared with a conventional electron gun assembly.

That is, if the electron gun assembly is constructed in a structure as described above, deterioration of the lens magnification and the spherical aberration in the vertical direction is prevented in the screen center part. Accordingly, the electron gun assembly described above can prevent deterioration of the resolution in the screen center part, due to increase of the electron beam spot diameter in the vertical direction, which is caused conventionally. Further, the electron beam spots at the peripheral part of the screen can be made to have a smaller diameter compared with a conventional electron gun assembly. Therefore, the electron beam spot diameter can be made small and uniform throughout the entire area of the phosphor screen, so that the resolution of the cathode ray tube apparatus can be improved.

Further, in the electron gun assembly described above, if the size and deflection angle of the cathode ray tube are large, deterioration of the resolution in the screen center part can be prevented. This is because even if the shape of each longitudinally elongated hole formed in the first intermediate electrode Gm1 is elongated much more, the longitudinally elongated holes formed in the first intermediate electrode Gm1 are provided at an area in the screen center part, which does not substantially cause focusing or diverging, and a potential distribution of the main lens is not changed at all.

Note that at the lowermost part 44 of the concave part 43 in the graph of the focusing effect, the focusing force may more or less shift although the focusing force should ideally be zero. No severe problem appears even if a more or less focusing force exists at the lowermost part 44 of this concave part 43. If the shift is too large, an electron lens whose lens magnification and aberration differ between the horizontal direction and the vertical direction. Accordingly, the focusing force of the lowermost part 44 needs to be set within an appropriate range. In addition, if the focusing force of the main lens itself is large, for example, the shift amount viewed from the entire main lens is relatively small even when the shift is more or less large. That is, the influence from this shift relatively concerns the focusing force of the main lens itself, so an excellent result can be obtained if the shift amount is substantially half of the uppermost focusing force of the main lens or less. Accordingly, Fx min and Fy min should desirably satisfy the expressions described below, where the focusing force in the horizontal direction at the lowermost part 44 is Fx min, the focusing force in the vertical direction at the lowermost part 44 is Fy min, and the uppermost focusing force of the main lens is F max.

$$F\max/2 \leqq |Fx\min| \leqq F\max/2 \text{ and}$$

$$F\max/2 \leqq |Fy\min| \leqq F\max/2 \text{ and}$$

Although the above embodiment is constructed in a structure which includes two intermediate electrodes, the present invention is not particularly limited to the above structure. As long as the effects as described above can be obtained, the structure may be arranged so as to include only one intermediate electrode or three or more intermediate electrodes, for example. The present invention is thus not limited by the number of intermediate electrodes.

Also, the above embodiment is constructed in a structure in which only one asymmetric electrode is provided in the main lens. Needless to say, however, the structure may be arranged so as to include two or more asymmetric electrodes. The present invention is thus not limited to the number of asymmetric electrodes.

Also, the above embodiment is constructed in a structure in which the deflection aberration is compensated for by only the focusing side of the main lens part. However, use can be available in combination with a structure in which asymmetric electrodes are provided at a boundary part between the large diverging area and the large focusing area of the main lens or in combination with a structure in which quadrapole lenses are provided at a part other than the main lens part. In this case, advantages such as improvement of design margins can be expected.

Also, the above embodiment is constructed in a structure in which the concave part 43 described above is formed in the large focusing area of the main lens part, with respect to the graph of the focusing effect. In contrast, however, the structure may be arranged such that the convex part (where the diverging force is weak) is formed in the large diverging area of the main lens part, that an area which does not substantially cause focusing or diverging is formed at the uppermost part (where the diverging force is weakest) of the convex part, and that the asymmetric electrode is provided near the uppermost part. Needless to say, the same effects as described above can be obtained even in this structure. In this structure, however, the quadrapole lens is formed in an area where the electron beam speed is high, and therefore, the quadrapole sensitivity is smaller compared with the above embodiment. However, since the quadrapole lens is formed in the side closer to the phosphor screen 12, the electron beam spot diameter can be reduced much more in the horizontal direction. This is advantageous for a cathode ray tube apparatus having a small size or deflection angle.

Also, the above embodiment is constructed in a structure in which the voltages that increase orderly from the focus electrode to the final acceleration electrode are applied to the intermediate electrodes Gm1 and Gm2. The present invention, however, is not limited to the embodiment described above. Needless to say, the structure may be arranged, for example, such that the voltage at the second intermediate electrode Gm2 is higher than the voltage at the first intermediate electrode Gm1, as long as the effects of compensation for deflection aberration and an enlarged effective diameter can be achieved.

Also, the above embodiment is arranged so as to apply a dynamic voltage to the focus electrode. The present invention, however, is not limited to the structure as described above but the structure may be arranged so as to apply a dynamic voltage to an intermediate electrodes. Further, the structure may be arranged so as to apply the dynamic voltage to a plurality of electrodes.

Also, the above embodiment is constructed in a structure in which an electron lens is formed with lens magnification and aberration which are substantially equal in both of the horizontal direction and the vertical direction at the center screen. Inversely, an electron lens with lens magnification and aberration which are substantially equal in both of the horizontal direction and the vertical direction may be formed at a peripheral part of the screen, and a laterally elongated hole, i.e., non-circular shaped hole may be formed in the first intermediate electrode Gm1, thereby to construct a structure in which a lens which compensates for the effect of the quadrapole lens formed at the main lens at the center screen is provided at a three-pole part or the like. It is then possible to attain the same effects as described above can be obtained. Accordingly, the electron lens may have a structure having same magnification and aberration in the horizontal direction as that in the vertical direction.

Although the above embodiment is constructed in a structure in which the main lens is of an enhanced-electric-field type, the embodiment may further be combined with a superimposing-type lens having an electric field common to the three electron beams, as a measure for much more enlarging the effective diameter. This is because the effects of the present invention can be obtained if the asymmetric electrode to be provided in the intermediate electrode is formed at the lowermost part 44 described previously. Therefore, a superimposing-type lens having an electric field common to the three electron beams may be provided in each of the electrodes that form part of the main lens.

Also, the above embodiment has been explained with respect to an electron gun assembly of a quadra-potential type. The present invention, however, is applicable also to cathode ray tube apparatuses that use other types of electron gun assemblies such as bi-potential type, uni-potential type, and tri-potential type electron gun assemblies, and the like.

Although the above embodiment has been explained with respect to a color cathode ray tube apparatus of an inline type, the electron gun assembly is constructed in a structure in which three independent electron lenses are formed in correspondence with three electron beams. Accordingly, the present invention is applicable also to a color cathode ray tube apparatus of a delta-type and to other types of cathode ray tube apparatuses such as a monochrome cathode ray tube apparatus and the like in which a single electron beam is emitted.

According to the present invention, there is provided a cathode ray tube apparatus comprising: an envelope having a screen; and an electron gun assembly constructed by a cathode for emitting an electron beam, and a main lens including a focus electrode, an intermediate electrode, and a final acceleration electrode, to focus the electron beam emitted toward the screen, the intermediate electrode being provided between the focus electrode and the final acceleration electrode wherein the main lens includes a focusing area positioned in a side of the focus electrode and having a focusing force, and a diverging area positioned in a side of the final acceleration electrode, having a diverging force, and succeeding the focusing area, the intermediate electrode has a hole having a non-circular shape allowing the electron beam to pass and is provided in the focusing area in the side of the focus electrode, and a focusing force curve expressing a focusing force along a tube-axis direction of the cathode ray tube apparatus in the focusing area has at least two convex parts respectively being at first and second levels, and a concave part being at a third level sufficiently lower than focusing forces of the first and second levels, the third level is set to a lowermost level at which a focusing or diverging force is not substantially effected on the electron beam or a focusing or diverging force is sufficiently small even if it is effected, the intermediate electrode is positioned near an area of the lowermost level, and at least one of the electrodes constructing the main lens is applied with a dynamic voltage which changes in synchronization with deflection of the electron beam.

In the cathode ray tube apparatus having the structure as described above, first and second electrodes are provided appropriately if the electron beam is not deflected but is situated at the center of the screen. When an appropriate voltage or the like is supplied, the main lens near the tube axis of the cathode ray tube apparatus has a large focusing area positioned in the side of the focus electrode and a large diverging area positioned in the side of the final acceleration electrode. In the large area, a concave part is formed and an area which does not substantially cause focusing or diverging is formed at the lowermost part of the concave part. If a longitudinally elongated hole formed in the first intermediate electrode Gm1 is provided at or near the lowermost part, the focusing force in the horizontal direction and the focusing force in the vertical direction become substantially equal to each other, regardless of an asymmetric electrode provided in the first intermediate electrode. Accordingly, an electron lens is formed with lens magnification and aberration each of which is substantially equal both in the horizontal and vertical directions. In addition, the main lens is formed to be an enhanced electric field lens having a large diameter, like in a conventional apparatus, and therefore, an electron beam spot having a true circular shape and a small diameter is formed on the center part of the screen.

On the other hand, when the electron beam is deflected toward a peripheral part of the screen, i.e., when a dynamic voltage is applied to the focus electrode, the potential distribution changes from that of the above-described case of not deflecting the electron beam, and a quadrapole lens is formed by the longitudinally elongated hole formed in the first intermediate electrode, so that a difference in focusing force is caused between the horizontal and vertical directions. Due to the quadrapole lens, a focusing effect is caused in the horizontal direction and a diverging effect is caused in the vertical direction. Further, the function of the main lens itself is weakened. Therefore, as an effect of the entire main lens, neither focusing nor diverging is caused in the horizontal direction, but the electron beam receives a strong diverging effect only in the vertical direction. Accordingly, it is possible to compensate for an over-focused state in the vertical direction, which is received from non-uniform magnetic field of the deflection yoke, with respect to the vertical direction, like in a conventional apparatus. With respect to the horizontal direction, a substantially focused state is achieved. Also, a quadrapole lens is formed in the side closer to the phosphor screen 12 compared with a conventional electron gun assembly, so that an electron beam spot diameter can be reduced and uniform throughout the entire area of the phosphor screen. The resolution of the cathode ray tube apparatus can thus be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

an envelope having a screen; and an electron gun assembly constructed by a cathode for emitting an electron beam, and a main lens including a focus electrode, an intermediate electrode, and a final acceleration electrode, to focus the electron beam emitted toward the screen, wherein the intermediate electrode is provided between the focus electrode and the final acceleration electrode, the main lens includes a focusing area positioned in a side of the focus electrode and having a focusing force, and a diverging area positioned in a side of the final acceleration electrode, having a diverging force, and being continuous to the focusing area, the intermediate electrode has at least one hole having a non-circular shape for allowing the electron beam to pass and is provided in the focusing area in the side of the focus electrode, and a focusing force curve expressing a focusing force along a tube-axis direction of the cathode ray tube apparatus in the focusing area has at least two convex parts respectively being at first and second levels, and a concave part provided between the convex parts and being at a third level sufficiently lower than focusing forces of the first and second levels, the third level is set to a lowermost level at which a focusing or diverging force is not substantially effected on the electron beam or a focusing or diverging force is sufficiently small even if it is effected, the intermediate electrode is positioned near an area of the tube-axis that corresponds to the lowermost level of the focusing force curve, and at least one of the electrodes constructing the main lens is applied with a dynamic voltage which changes in synchronization with deflection of the electron beam.

2. The cathode ray tube apparatus according to claim 1, wherein the focusing force or diverging force at the lowermost level has an absolute value which is substantially equal to or less than half of an uppermost focusing force which can be effected by the main lens.

3. The cathode ray tube apparatus according to claim 1, wherein an asymmetric intermediate electrode is provided at or near a boundary part between the large focusing area positioned in the side of the focus electrode and the large diverging area positioned in the side of the final acceleration electrode.

4. The cathode ray tube apparatus according to claim 2, wherein an asymmetric intermediate electrode is provided at or near a boundary part between the large focusing area positioned in the side of the focus electrode and the large diverging area positioned in the side of the final acceleration electrode.

5. The cathode ray tube apparatus according to claim 1, wherein a quadrapole lens is provided in a side of the cathode of the main lens, and a dynamic voltage which changes in synchronization with deflection of the electron beam is applied to an electrode constructing the quadrapole lens.

6. The cathode ray tube apparatus according to claim 2, wherein a quadrapole lens is provided in a side of the cathode of the main lens, and a dynamic voltage which changes in synchronization with deflection of the electron beam is applied to an electrode constructing the quadrapole lens.

7. The cathode ray tube apparatus according to claim 3, wherein a quadrapole lens is provided in a side of the cathode of the main lens, and a dynamic voltage which changes in synchronization with deflection of the electron beam is applied to an electrode constructing the quadrapole lens.

8. A cathode ray tube apparatus comprising:

an envelope having a screen; and an electron gun assembly constructed by a cathode for emitting an electron beam, and a main lens including a focus electrode, an intermediate electrode, and a final acceleration electrode, to focus the electron beam emitted toward the screen, wherein the intermediate electrode being provided between the focus electrode and the final acceleration electrode, the main lens includes a focusing area positioned in a side of the focus electrode and having a focusing force, and a diverging area positioned in a side of the final acceleration electrode, having a diverging force, and being continuous to the focusing area, the intermediate electrode has at least one hole having a non-circular shape for allowing the electron beam to pass and is provided in the diverging area in the side of the final acceleration electrode, a focusing force curve expressing a focusing force along a tube-axis direction of the cathode ray tube apparatus in the diverging area has a convex part, the focusing force curve at the convex part includes a part being at an uppermost level, the uppermost level is set such that a focusing or diverging force is not substantially effected on the electron beam or a focusing or diverging force is sufficiently small even if it is effected, the intermediate electrode is positioned near an area of the tube-axis that corresponds to the uppermost level of the focusing force curve, and the electrode constructing the main lens is applied with a dynamic voltage which changes in synchronization with deflection of the electron beam.

9. The cathode ray tube apparatus according to claim 8, wherein the focusing force or diverging force at the uppermost level has an absolute value which is substantially equal to or less than half of an uppermost diverging force which can be effected by the main lens.

10. A cathode ray tube apparatus comprising:

an envelope having a screen; and an electron gun assembly constructed by a cathode for emitting an electron beam, and a main lens including a focus electrode, an intermediate electrode, and a final acceleration electrode, to focus the electron beam emitted toward the screen, wherein the intermediate electrode being provided between the focus electrode and the final acceleration electrode, the main lens includes a focusing area positioned in a side of the focus electrode and having a focusing force, and a diverging area positioned in a side of the final acceleration electrode, having a diverging force, and being continuous to the focusing area, the intermediate electrode has at least one hole having a non-circular shape for allowing the electron beam to pass and is provided in the focusing area in the side of the focus electrode and in the diverging area in the side of the final acceleration electrode, a focusing force curve expressing a focusing force along a tube-axis direction of the cathode ray tube apparatus in the focusing area has at least two convex parts respectively being at first and second levels and a concave part provided between the convex parts and being at a third level which is sufficiently smaller than focusing forces of the first and second levels, the third level is set to a lowermost level at which a focusing or diverging force is not substantially effected on the electron beam or a focusing or diverging force is sufficiently small even if it is effected, a first portion of the intermediate electrode having the at least one hole includes a first group of holes having the non-circular shape and positioned near an area of the tube-axis that corresponds to the lowermost level of the focusing force curve, a second portion of the intermediate electrode is provided in the diverging area in the side of the final acceleration electrode, the focusing force curve expressing the focusing force along the tube-axis direction of the cathode ray tube apparatus in the diverging area is formed to be a convex part, the focusing force curve at the convex part has a part being at an uppermost level, the uppermost level is set such that a focusing or diverging force is not substantially effected on the electron beam or a focusing or diverging force is sufficiently small even if it is effected, the second portion of the intermediate electrode having the at least one hole includes a second group of holes having the non-circular shape and positioned near an area of the tube-axis that corresponds to the uppermost level of the focusing force curve, and the electrode constructing the main lens is applied with a dynamic voltage which changes in synchronization with deflection of the electron beam.

11. The cathode ray tube apparatus according to claim 10, wherein an asymmetric intermediate electrode is provided at or near a boundary of the large focusing area positioned in the side of the focus electrode and the large diverging area positioned in the final acceleration electrode.

* * * * *